US010058485B2

(12) United States Patent
Stevens

(10) Patent No.: US 10,058,485 B2
(45) Date of Patent: Aug. 28, 2018

(54) IMPROVEMENTS RELATING TO BLISTER PACKAGE COMPLIANCE

(71) Applicant: Manrex Pty. LTD, Leichhardt (AU)

(72) Inventor: Gerard Stevens, Huntley's Point (AU)

(73) Assignee: Manrex Pty. Ltd., Leichhardt, NSW (AU)

( * ) Notice: Subject to any disclaimer, the term of this patent is extended or adjusted under 35 U.S.C. 154(b) by 16 days.

(21) Appl. No.: 15/122,767

(22) PCT Filed: Feb. 26, 2015

(86) PCT No.: PCT/AU2015/000103
§ 371 (c)(1),
(2) Date: Aug. 31, 2016

(87) PCT Pub. No.: WO2015/131224
PCT Pub. Date: Sep. 11, 2015

(65) Prior Publication Data

US 2017/0071827 A1 Mar. 16, 2017

(30) Foreign Application Priority Data

Mar. 3, 2014 (AU) ..... 2014900729

(51) Int. Cl.
*A61J 1/00* (2006.01)
*A61J 7/04* (2006.01)
(Continued)

(52) U.S. Cl.
CPC ..... *A61J 7/0436* (2015.05); *A61J 1/035* (2013.01); *A61J 1/16* (2013.01); *A61J 7/0418* (2015.05);
(Continued)

(58) Field of Classification Search
CPC ..... A61J 7/0436; A61J 7/0418; A61J 1/035; A61J 1/16; A61J 7/0481; A61J 2200/30
(Continued)

(56) References Cited

U.S. PATENT DOCUMENTS

2002/0017996 A1* 2/2002 Niemiec ..... A61J 7/0481 340/573.1
2008/0303665 A1 12/2008 Naik et al.
(Continued)

FOREIGN PATENT DOCUMENTS

WO 2003/073977 A2 9/2003
WO 2009/116108 A1 9/2009

OTHER PUBLICATIONS

Australian Patent Office, International Searching Authority, International Search Report, issued in PCT/AU2015/000103, dated Apr. 2, 2015, Woden, AU, 4 pages.

*Primary Examiner* — Daryl Pope
(74) *Attorney, Agent, or Firm* — Chernoff, Vilhauer, McClung & Stenzel, LLP

(57) ABSTRACT

A holder (12) for checking non-compliance of a blister package has a pocket (60) into which the blister package is inserted. The front of the pocket is a transparent plate (128). Rectangular openings of wells (133) in the front face of the box (121) are positioned behind the blisters of the blister package. Each well contains light-sensitive elements (134). Non-compliance occurs when a blister of a used blister package is in an unopened condition. The sensing elements (134) detect this by ambient light in the pocket not reaching the elements. An electrical circuit in the box (121) monitors the elements (134) and provides a signal indicating a non-compliance condition if a blister in the returned package is unopened. Information identifying the unopened blister is stored in the circuit. A variable light source can be provided.

12 Claims, 4 Drawing Sheets

(51) Int. Cl.
*A61J 1/03* (2006.01)
*A61J 1/16* (2006.01)

(52) U.S. Cl.
CPC ..... *A61J 7/0481* (2013.01); *A61J 2200/30* (2013.01); *A61J 2200/70* (2013.01)

(58) Field of Classification Search
USPC ..... 340/309.16, 309.7
See application file for complete search history.

(56) References Cited

U.S. PATENT DOCUMENTS

| | | | |
|---|---|---|---|
| 2009/0294521 | A1 | 12/2009 | De La Huerga |
| 2011/0100862 | A1 | 5/2011 | Turkington et al. |
| 2013/0134180 | A1 | 5/2013 | Cheyene |
| 2013/0319902 | A1 | 12/2013 | Tufi |

* cited by examiner

IMPROVEMENTS RELATING TO BLISTER PACKAGE COMPLIANCE

FIELD OF THE INVENTION

This invention relates to monitoring the administration to a patient of medication doses prescribed by a doctor and contained in an array of blisters of a blister package, each blister containing the prescribed doses to be administered to the patient at the time and on the day denoted by the position of the blister in the array of blisters.

STATE OF THE ART

The blister packaging of prescribed doses to be administered to a patient is being increasingly used nowadays in place of providing the patient with an assortment of bottles of medication tablets and relying on the patient correctly administering the prescribed medication doses at the times prescribed by a doctor. In effect, the blister packaging of the medication doses by a pharmacist transfers from the patient to the pharmacist the responsibility of selecting the different doses to be administered at a particular time on a particular day.

Legend associated with the rows and columns of blisters in the array is printed on the package to identify the day and time at which the medication doses in the blister are to be administered. The blisters are moulded from a plastics sheet which is sufficiently soft and flexible to allow manual pressure exerted by a patient's fingers on a blister to eject the contained medication doses through an easily-ruptured friable foil covering the back of the blister sheet. The foil serves to seal the blisters and to isolate them from one another. Typically such a blister package will have at least twenty-eight blisters which is sufficient to provide most patients with a week's supply of prescribed medication doses.

Although blister packaging is a significant step forward in the administration of medication doses, it still relies on the patient remembering to administer the medication doses at the time signified by the position of a blister on the blister sheet. Elderly patients do not always have a good memories and it happens from time-to-time that a blister is not opened at the correct time or that two blisters are inadvertently opened and their contents administered in quick succession. With modern powerful drugs present in some medications, the effect of a patient overdosing or failing to take the prescribed medication doses at the correct time can have serious consequences. To lessen the risk of this occurring various techniques have been employed to enable the pharmacist who packaged the prescribed medication doses, to check that all of the blisters have been opened. Such checking can be carried out by arranging for the patient to return the previously-issued blister package before a new one is issued. If the patient returns a blister package at the correct date but it still has one or more unopened blisters, the lack of compliance with the original prescription will be immediately apparent. Likewise if the patient returns a blister package to the pharmacist a day or so early and with all of the blisters opened, this may also indicate a lack of compliance.

Unfortunately the above techniques for indication a possible lack of compliance do not provide the pharmacist with information indicating when a particular blister was opened and this information can be important for ensuring the good health of the patient.

OBJECT OF THE INVENTION

An object of this invention is to provide a device for checking whether any of the blisters of a used blister package returned by a patient have not been opened.

THE INVENTION

In accordance with the present invention a holder for storing a blister package between times of use, has: a manually-releasable device for retaining the blister package in a predetermined position in the holder; an array of sensing elements located in the holder at positions corresponding to those of blisters of the blister package when held at the predetermined position; an electrical circuit monitoring the sensing elements and responding to them indicating that one of the blisters is in an unopened condition; a memory in the circuit for holding data significant of a prescribed medication plan; a comparator in the circuit connected to the sensing elements and the memory, and to respond to the detection of an unopened blister by producing a non-compliance signal to an indicator capable of being interrogated when required; a timer providing information of the time at which an unopened blister is detected; and a store in the circuit for providing from the outputs of the timer and the indicator a non-compliance signal significant of the time an unopened blister is detected and its position on the blister package

PREFERRED FEATURES OF THE INVENTION

The preferred characteristic sensed by the sensing elements is the extent to which light is reflected by the foil backing strip of the blister package. A sensing element such as a light-pulse generator in the holder may be activated to direct a pulse of light, such as an infrared light beam, towards the foil. A ruptured region of the foil will reflect a different amount of the incident light back towards the sensing element as compared with that reflected when the foil is intact. The circuit can then retain the time at which the chosen characteristic changed and the position on the blister package of the non-complying blister.

Other characteristics of the foil which change when it is ruptured, may also be used to detect non-compliance. For example a change in the magnetic characteristics of the foil or in its electrical properties such as its electrical resistance or induction may also be used to detect when a region of the foil is intact when it should have been ruptured.

One way of retaining the blister package in the holder is to provide connections in the form of a pair of opposed channels on one pair of sides of the holder. These channels are conveniently shaped to accommodate the marginal edges of the blister package when it occupies the predetermined position in the holder. An electrical switch may be mounted in one of the channels and operates to prevent activation of the electrical circuit if the blister package is not occupying the predetermined position.

Suitably the holder is constructed as a flat platen in which the sensing elements and circuitry are embedded. The platen may be provided with a pocket into which the blister package may be slid in order to guide it to the predetermined position. When light-sensitive elements are used to detect rupturing of the regions of the foil backing strip behind respective blisters, ambient light intensity may adversely affect the detection of non-compliance. This problem can be overcome by providing an adjustable light source to illuminate the blistered side of the package in order to supplement the ambient light to an extent which ensures a clear difference between the responses of the light-sensitive element respectively to the presence or absence of a ruptured region of the foil backing strip.

INTRODUCTION TO THE DRAWINGS

The invention will now be described in more detail, by way of two examples and with reference to accompanying partially diagrammatic drawings, in which:—

In the drawings

DESCRIPTION OF FIRST EXAMPLE

Figure 1:
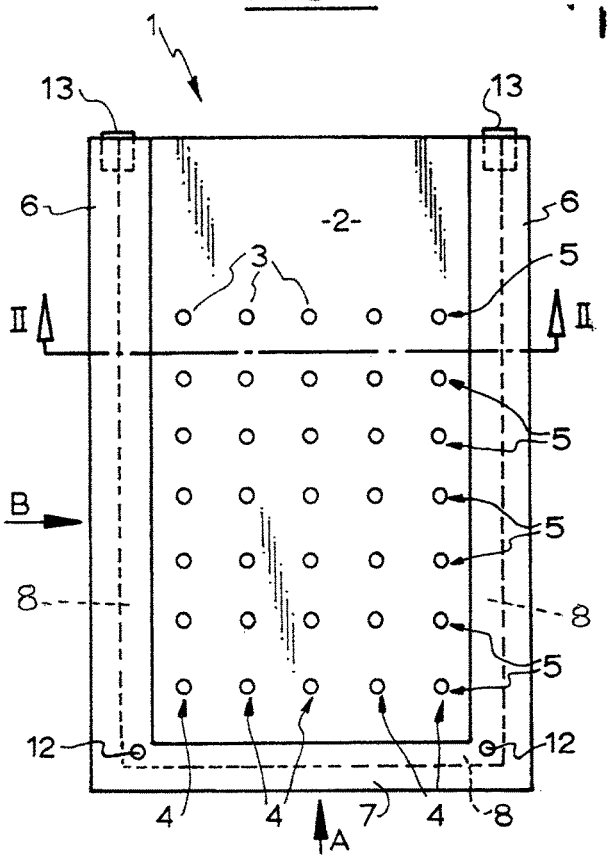
FIG. 1 is a plan view of one example of a holder for a blister package.
Figure 2:
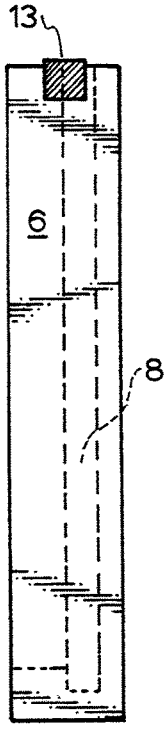
FIG. 2 is a side view of the holder of FIG. 1 as viewed in the direction of the arrow "B" in FIG. 1.
Figure 5:
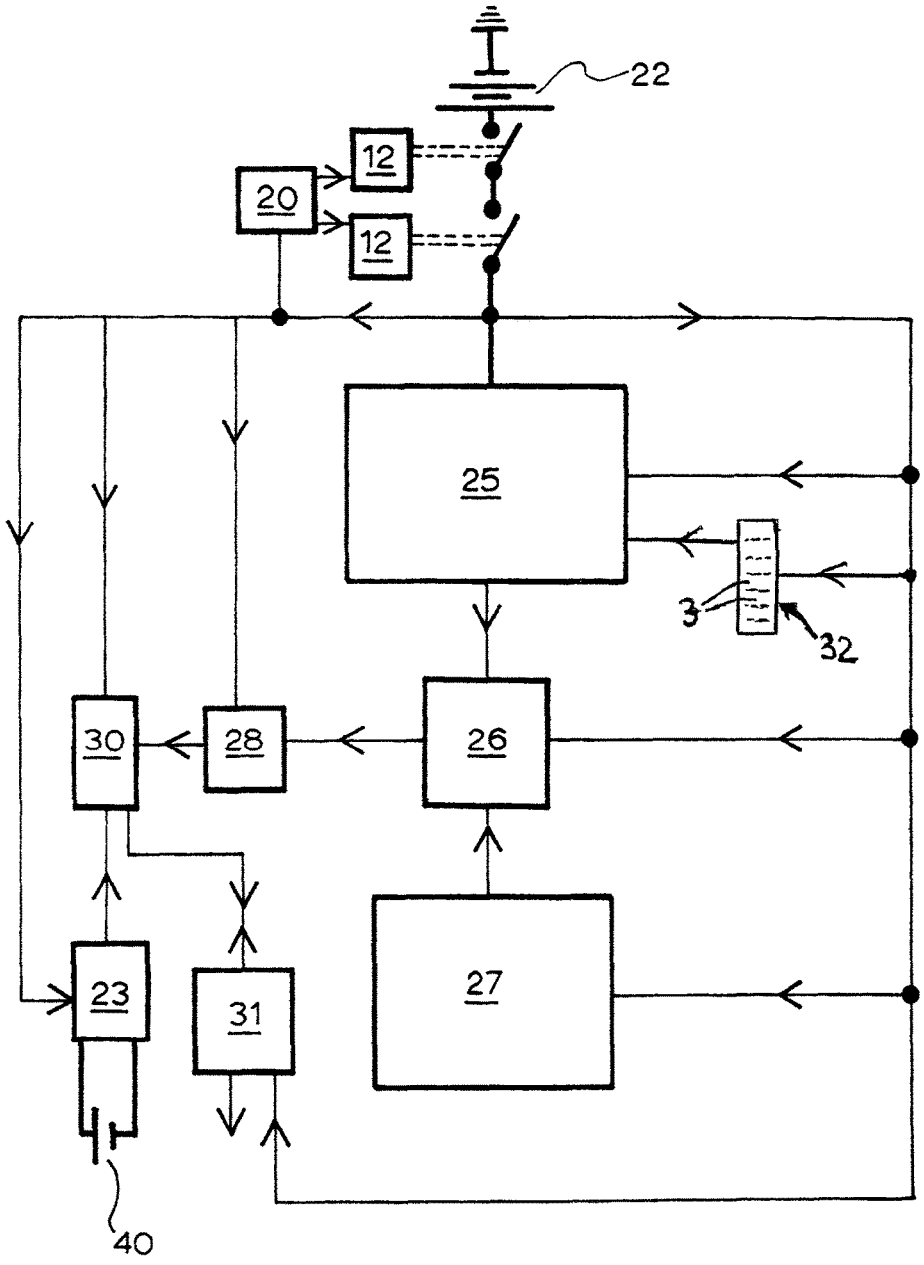
FIG. 5 is a block schematic diagram of one arrangement of an electrical circuit embedded in the holder of FIG. 1 and used to detect compliance of the blister package with the requirements of a medical prescription provided by a doctor for the patient identified on the blister package.

FIG. 1 shows a holder 1 having a flat rectangular central panel 2 made of a hard plastics material and in which is embedded an array of thirty-five sensing elements 3 forming part of a compliance detection circuit shown in more detail in FIG. 5. The elements 3 are arranged in five vertical columns 4 and seven horizontal rows 5. This configuration of the array of elements depicted in FIG. 1 is just one of a large number of circuit configurations which can be used to carry out the invention.

Figure 3:
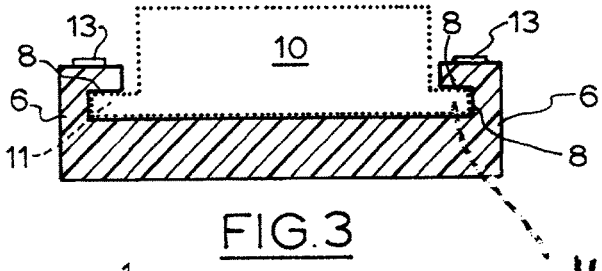
FIG. 3 is a cross-section through the holder of FIG. 1 taken on the line and in the direction indicated by the arrows II-II in FIG. 1, the position of the blister package at the predetermined position in the holder being shown in phantom outline.
Figure 4:
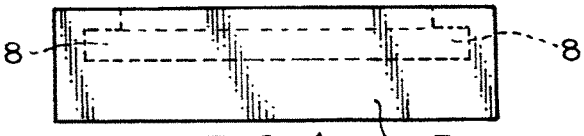
FIG. 4 is an end view of the holder as seen in the direction of the arrow "A" in FIG. 1.

The panel 2 has two opposed side members 6 and one base member 7. These members are formed with respective coplanar channels 8 as is shown in FIGS. 3 and 4. FIG. 3 also shows in phantom outline a blister package 10 having three marginal edges 11 which respectively locate in the channels 8 when the blister package 10 is in a predetermined position in the holder 1. Two position-sensing switches 12 are respectively located in opposite ends of the channel 8 of the base member 7 and provide signals when the blister package 10 occupies a predetermined position in the holder at which its compliance can be checked. Retaining devices 13, such as the pair of straps made of VELCRO (trade mark) material, are located at the upper ends of the side-channels 8 and serve to hold the blister package 10 in the predetermined position during transportation and when checking the compliance of the blister package.

Blister packages used in the pharmacy industry to provide prescribed medications to a patient are well-known in the art and therefore will not be described in detail here. However a brief description of one such package may assist the reader. This blister package has a rectilinear array of blisters each containing doses of medication prescribed by a doctor. The position of each blister on the array denotes a particular time on a specific day on which the doses in that blister are to be administered to the patient. The days and times at which the medication doses are to be administered, indicated by appropriate lettering on the sides and ends of the blister columns. The blisters are moulded out of a sheet of a soft, transparent plastics material. The back of the blister sheet is covered by an easily-ruptured, friable, foil backing strip which serves to seal the medication doses in the cavities of the individual blisters. Each of the blisters, being soft, is manually depressible to eject its contents through the region of the backing strip closing the blister cavity. The portions of the foil backing strip surrounding each blister adheres to coplanar portions of the blister sheet lying between the blisters so that the opening of one blister leaves the neighboring sealed blisters intact.

FIG. 5 shows one form of electrical circuit usable to detect whether there is compliance. It contains a memory 27 in which is loaded data obtained from a binary code printed on the blister package 10 and significant of the days and times at which the prescribed medications are to be administered to the patient.

A battery 22 powers the circuit of FIG. 5 which, however, remains de-energized until both of the switches 12 are closed. The switches 12 are normally in their open states as shown, but close when the blister package 10 is in the predetermined position in the holder. A master switch 20 under the control of the pharmacist, can be used to prevent closure of the switches 12 until such times as the pharmacist wishes to carry out a compliance check. Such control may also be exercised remotely by a signal from a telephone line or other device at times when remote monitoring of the compliance is to be carried out. If the blister package is not occupying the predetermined position in the holder, the retaining devices 13 are designed to prevent them from being moved to positions which would indicate that checking for compliance can commence.

Operation of the First Example

The array of sensing elements 3 shown in FIG. 1 are individually associated with regions of the backing sheet closing respective blister cavities. The circuitry of FIG. 5 is energized by the closure of switches 12 and 20 to cause each of the sensing elements 3, shown diagrammatically in FIG. 5 by the box 32, to transmit a pulse of light towards the associated region of the foil backing strip and to sense from the intensity of the reflected light whether there has been a change in the reflective characteristic of the region. If there is no change, then the blister is intact. On the other hand if the intensity of the reflected light has diminished, this would signify that the blister had been opened. The reflective characteristics of each of the regions of the foil backing strip are stored in a register 25.

The information stored in the register 25 is compared by a comparator circuit 26 with the contents of the memory 27. This is set up initially by the doctor's prescription. As long as the condition of the regions at a particular time and date agrees with the information provided by the memory 27 there is correct compliance and no signal is sent to an indicator circuit 28. On the other hand, if the condition of a region does not agree with that stored in the memory, this non-compliance condition causes the comparator circuit 26 to send a signal to the indicator circuit 28 which responds by recording the non-compliance of the region in a store 30. Simultaneously the store 30 records the time at which the non-compliance is indicated, this information being obtained from a continuously running timing circuit 23 having its own power source 40.

An interrogator circuit 31 is connected to the store 30 to enable its contents to be down-loaded from time-to-time. Operation of the interrogator circuit 31 permits the contents of the store 30 to be transmitted to a display (not shown) to indicate to a pharmacist whether there has been compliance by the patient with the prescription provided by the doctor. A facility 31 may also be provided to enable the contents of the store 30 to be down-loaded and transmitted to a remote location by way of a telephone line, a radio signal or some other means of communication, so that someone at the remote location can monitor the compliance and also, if required, the location of the person so that immediate medical attention can be given if necessary.

The master switch 20 incorporates a time-delay circuit (not shown) preventing it from opening the switches 12 for a predetermined period after an interrogation of the store 30 from a remote location has begun. This time delay ensures that the interrogation sequence of the circuitry of FIG. 5 can be completed before the battery 22 is disconnected.

Description of the Second Example

Figure 6:
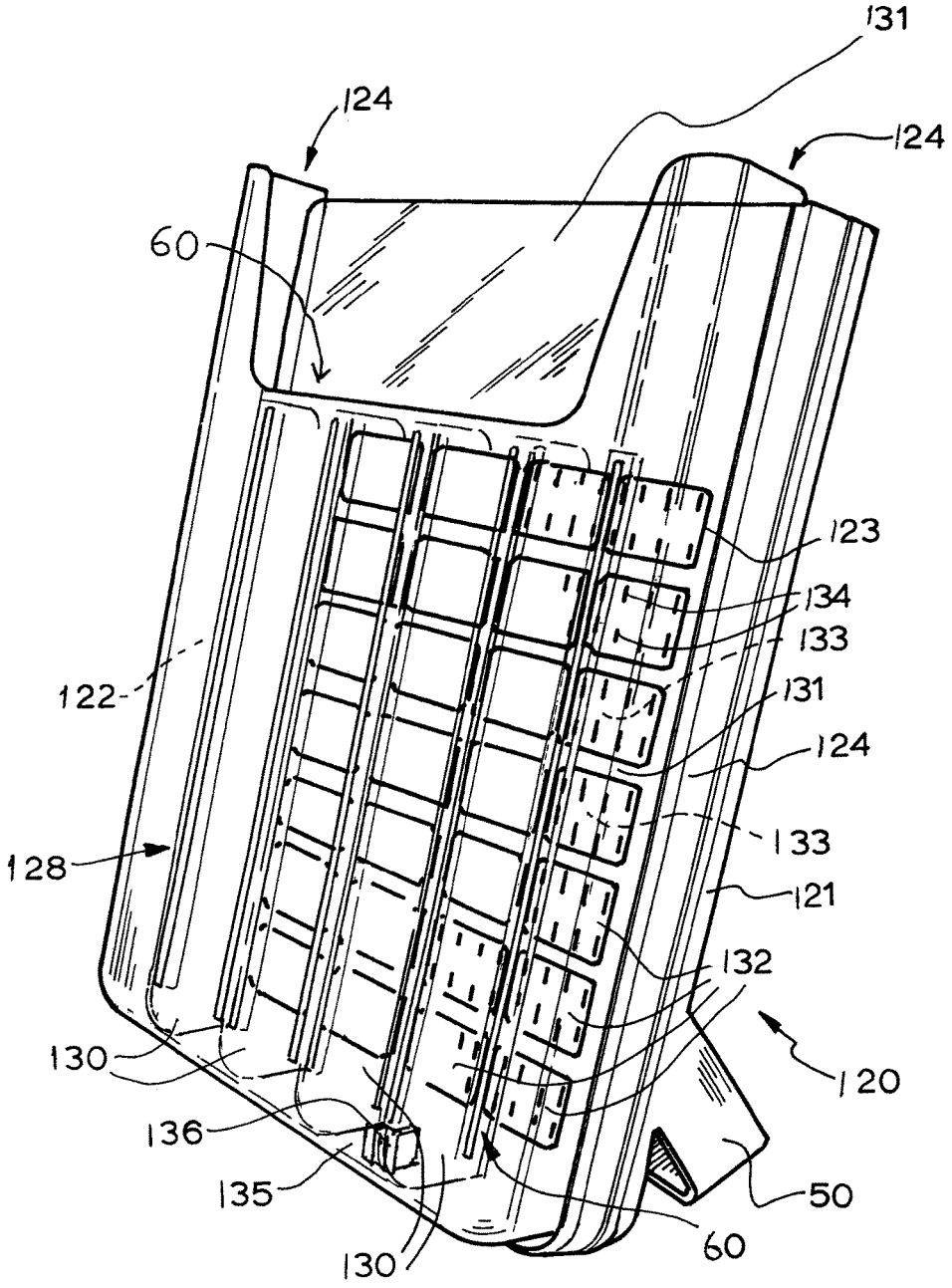
FIG. 6 is a perspective side view of a second example of holder provided with a stand and employing the circuit shown in FIG. 5; and, FIG. 7 is a view corresponding to FIG. 6 and showing a blister package partially inserted into a pocket in the holder.
Figure 7:
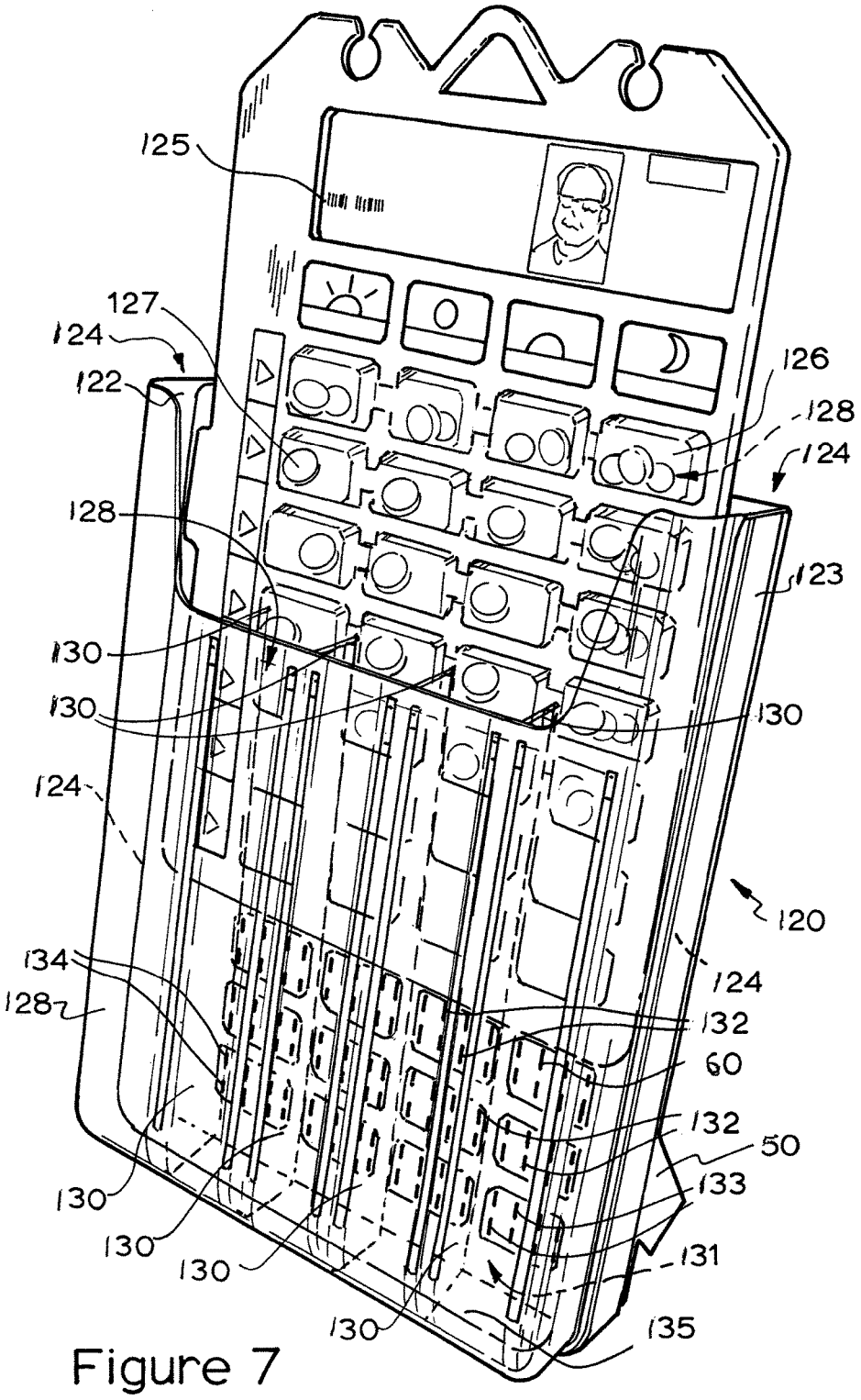

Turning now to the second example of the invention shown in FIGS. 6 and 7, the holder 120 comprises a shallow rectangular box 121 containing electronic circuitry energized from an external power source (not shown). A stand 50 behind the holder 120 enables it to be stood in an upright but tilted slightly backwards position when required for use.

Two side walls 122 and 123 extend upwardly from opposite sides of the box 121 and respectively provide opposed channels 124 to accommodate opposite parallel side-edges of a blister package 125 shown partially inserted into the holder 120 of FIG. 7. The blister package 125 has a rectilinear array of blisters 126 that originally contained prescribed doses of medication 127 sealed into the cavities of the blisters by respective regions of a friable foil backing strip 126 as is usual with a conventional blister package.

A transparent top-plate 128 is attached at its sides to the tops of the side-walls 122 and 123 and is provided on its underside with four downwardly-extending, spaced, parallel transparent guide strips 130 as shown in FIG. 7. The guide strips preferably have their upper ends cut-away at an angle so that they provide a convergent mouth to facilitate smooth insertion of the package 125 into a parallelepiped shaped pocket 60 in the holder 120.

As shown in FIG. 6 an opaque flat plate 131 covers one face of the box 121 and is formed with a rectilinear array of generally rectangular openings 132 formed in the front surface of the box 121. Each of the openings 132 frames a well 133 having a set of eight light-sensitive elements 134 located in its floor. An abutment wall 135 projects outwardly from the lower end of the plate 131 and a contact switch 136 is mounted on it at a position at which it is operated by the lower edge of the package 125 when it is fully inserted into the pocket 60 and occupies a predetermined position in it.

As is apparent from FIG. 7 the guide strips 130 are so positioned that they allow the blister columns of the blister package 125 which is to be tested for compliance, to pass between them during insertion of the blister package into the pocket 60. This pocket 60 is defined at its sides by the elongated channels 124; at its front by the under edges of the guide strips 130; and, at its base by the abutment wall 135 which, as shown in FIG. 6, has a contact switch 136 mounted on it.

Operation of the Second Example

During insertion of the blister package 125 into the pocket 60, its friable foil backing strip is held by the undersides of the guide strips 130 against the front surface of the plate 131 to prevent the possibility of light leakage between the wells 133. Insertion of the blister package into the pocket 60 is completed when the bottom edge of the package 125 engages and operates the switch 136. Switch 136 serves the same purpose as the two switches 12 in the first example of the invention described above. Retaining devices, such as turnbuckles, clips, or the straps 30 mentioned in the first example of the invention, may be used to hold the package 125 in its fully-inserted or predetermined position in the pocket 60 so that the switch 136 remains operated and a compliance check can be carried out.

Adjustable, artificial light sources (not shown) are provided in the holder 120 to provide, when necessary, additional light to supplement the available ambient light. This additional light is transmitted from the light sources by way of the transparent top plate 128 and the guide strips 130 to the blistered side of the package 125. The magnitude of the illumination provided by the light sources can be varied to compensate for the prevailing ambient light being inadequate to provide a clear difference in the responses of the light-sensitive elements necessary to distinguish between a region of the foil being intact or ruptured.

Initial Calibration of the Holder

In order to calibrate the holder 120 before its initial use, an unopened test blister package 125 is located in the predetermined position in the pocket 60 of the holder. An integrated signal is then generated by the sensing elements 134. This determines the threshold level of operation. The test blister package 125 is then removed from the pocket 60 and the region of its foil backing strip behind one of the blisters is ruptured. The test blister package 125 is then replaced in the pocket 60 and the calibration test is repeated. This should generate a second integrated signal indicating that at least one of the blisters has been opened. If the two generated signals are judged to be too close to one another in magnitude, the level of ambient light present is inadequate for the light-sensitive elements to distinguish clearly between the presence or absence of a ruptured foil. It then becomes necessary to supplement the prevailing ambient light with additional light obtained from the artificial light sources mentioned above. This additional light is transmitted by way of the transparent top-plate 128 of the holder and the four transparent strips 130 to the interior of the pocket 60. In this way the intensity of the light in the pocket 60 can be varied to bring it to a level in which a clear distinction can be drawn between the presence and absence of a ruptured foil. The test blister package can then be removed and replaced by the blister package that is to be checked for non-compliance.

If, during the compliance check, a foil region behind one of the blisters is intact, this will be detected by an absence of a signal from any of the eight light-sensing elements 134 in the well 133 immediately behind the intact foil area. The drop in the resultant integrate signal generated by the eight sensors 34 signifies that the corresponding blister is still sealed and thus the medication doses in its cavity have not been administered to the patient. A corresponding signal can then be generated by the circuit of FIG. 5 to signify the position of the blister from which a non-compliance signal has been generated and the time when such non-compliance was found.

The invention claimed is:

1. A holder for storing a blister package between times of use, comprising:

a transparent pocket in the holder, adapted to receive and hold a blister package, and a manually-releasable device for retaining the blister package in the transparent pocket in the holder;

an array of sensing elements located in the holder at positions corresponding to respective positions of blisters of the blister package when the blister package is held at a predetermined position in the pocket;

an electrical circuit monitoring the sensing elements and responding to an absence of light falling on the sensing elements to indicate the presence of an unopened blister in the blister package;

a memory in the electrical circuit for holding data significant of a prescribed medication plan;

a comparator in the electrical circuit, connected to the sensing elements and to the memory, and arranged to respond to the detection of the unopened blister by producing a non-compliance signal to an indicator capable of being interrogated when required;

a timer providing information of a time at which an unopened blister is detected; and a store in the circuit adapted to provide from the outputs of the timer and the indicator a non-compliance signal significant of the time an unopened blister is detected and its position on the blister package.

2. A. holder as claimed in claim 1, in which the electrical circuit is embedded in the holder behind the pocket.

3. A holder as claimed in claim 2, including a switch located in the holder and arranged to prevent a compliance check from being carried out unless a blister package is correctly positioned in the pocket.

4. A holder as claimed in claim 1, including a switch located in the holder and arranged to prevent a compliance check from being carried out unless a blister package is correctly positioned in the pocket.

5. A holder as claimed in claim 4, including an additional, variable light source operable to provide additional light inside the pocket if the prevailing ambient light is insufficient for a compliance check to be carried out.

6. A holder as claimed in claim 5, including transparent portions adapted to transmit ambient light into the pocket and also transmit the additional light provided by the variable light source into the pocket.

7. A holder as claimed in claim 3, including an additional, variable light source operable to provide additional light inside the pocket if the prevailing ambient light is insufficient for a compliance check to be carried out.

8. A holder as claimed in claim 7, including transparent portions adapted to transmit ambient light into the pocket and also transmit the additional light provided by the variable light source into the pocket.

9. A holder as claimed in claim 2, including an additional, variable light source operable to provide additional light inside the pocket if the prevailing ambient light is insufficient for a compliance check to be carried out.

10. A holder as claimed in claim 9, including transparent portions adapted to transmit ambient light into the pocket, and also transmit the additional light provided by the variable light source into the pocket.

11. A holder as claimed in claim 1, including an additional, variable light source operable to provide additional light inside the pocket if the prevailing ambient light is insufficient for a compliance check to be carried out.

12. A holder as claimed in claim 11, including transparent portions adapted to transmit ambient light into the pocket and also transmit the additional light provided by the variable light source into the pocket.

* * * * *